US008302318B2

(12) United States Patent
Saunders

(10) Patent No.: US 8,302,318 B2
(45) Date of Patent: Nov. 6, 2012

(54) AIMING SYSTEM FOR SLINGSHOTS AND PROJECTILE-LAUNCHING DEVICES

(76) Inventor: Charles A. Saunders, Columbus, NE (US)

( * ) Notice: Subject to any disclaimer, the term of this patent is extended or adjusted under 35 U.S.C. 154(b) by 269 days.

(21) Appl. No.: 12/684,099

(22) Filed: Jan. 7, 2010

(65) Prior Publication Data

US 2010/0170494 A1 Jul. 8, 2010

Related U.S. Application Data

(60) Continuation-in-part of application No. 12/343,978, filed on Dec. 24, 2008, now Pat. No. 7,827,977, which is a division of application No. 11/302,792, filed on Dec. 14, 2005, now Pat. No. 7,484,505.

(60) Provisional application No. 60/638,547, filed on Dec. 22, 2004, provisional application No. 61/143,153, filed on Jan. 7, 2009.

(51) Int. Cl.
*F41B 7/00* (2006.01)

(52) U.S. Cl. ..... 33/227; 124/20.1

(58) Field of Classification Search ..... 33/265, 33/227; 124/87
See application file for complete search history.

(56) References Cited

U.S. PATENT DOCUMENTS

| | | | | | |
|---|---|---|---|---|---|
| 844,665 | A | * | 2/1907 | Dills | 124/20.1 |
| 2,610,405 | A | * | 9/1952 | Dickinson | 42/143 |
| 2,613,659 | A | * | 10/1952 | Hutson | 124/20.3 |
| 2,658,495 | A | * | 11/1953 | Elliot, Sr. | 124/7 |
| 4,179,613 | A | * | 12/1979 | Koren | 250/215 |
| 4,198,949 | A | * | 4/1980 | Cook | 124/20.1 |
| 4,273,094 | A | * | 6/1981 | Hogan | 124/20.1 |
| 4,911,136 | A | * | 3/1990 | Brown | 124/20.1 |
| 5,442,861 | A | | 8/1995 | Lorocco | |
| 5,560,113 | A | | 10/1996 | Simo et al. | |
| 5,619,801 | A | | 4/1997 | Slates | |
| 5,638,604 | A | | 6/1997 | Lorocco | |
| 5,762,056 | A | * | 6/1998 | Kysilka | 124/20.3 |
| 5,803,067 | A | | 9/1998 | Ellenburg et al. | |
| 5,810,363 | A | * | 9/1998 | Saunders et al. | 273/407 |
| 5,894,672 | A | | 4/1999 | Ellenburg et al. | |
| 5,918,585 | A | | 7/1999 | Blanchard | |
| 6,016,608 | A | | 1/2000 | Lorocco | |
| 6,115,928 | A | | 9/2000 | Dauerer | |
| 6,131,295 | A | | 10/2000 | Cranston | |
| 6,564,787 | B1 | | 5/2003 | Barry | |
| 6,754,968 | B2 | * | 6/2004 | Lee | 33/263 |
| 6,786,213 | B1 | * | 9/2004 | Lee | 124/20.1 |
| 6,823,855 | B2 | | 11/2004 | Omi | |
| 6,851,675 | B1 | * | 2/2005 | Jakubec et al. | 273/355 |

(Continued)

*Primary Examiner* — G. Bradley Bennett
*Assistant Examiner* — Tania Courson
(74) *Attorney, Agent, or Firm* — Levenfeld Pearlstein, LLC

(57) ABSTRACT

An aiming system is disclosed. The aiming system may be used with various slingshot and projectile-launching devices, but is particularly useful for use with "shoot-over" slingshots. The aiming system comprises a clip or other device with an integrated aiming or sighting system. In the preferred embodiment, the integrated aiming system comprises a plurality of fiber optic strands disposed within the clip and terminating at the rearward face of the clip. In this matter, the tips of the fiber optic strands provide a series of illuminated points allowing the user of a device to look forward while shooting and to align the points with the target. The points may be color coded to aid in the aiming process.

20 Claims, 20 Drawing Sheets

U.S. PATENT DOCUMENTS

| | | | | |
|---|---|---|---|---|
| 6,968,835 | B2 | 11/2005 | Lee | |
| 7,159,325 | B2 | 1/2007 | Rager | |
| 7,343,686 | B2 | 3/2008 | Rager | |
| 7,484,505 | B1 | 2/2009 | Saunders | |
| 7,708,674 | B1 * | 5/2010 | Saunders | 482/122 |
| 7,909,329 | B1 * | 3/2011 | Martinson | 273/330 |
| 2008/0087263 | A1 * | 4/2008 | Chee | 124/20.3 |
| 2009/0193329 | A1 | 7/2009 | Saunders | |

* cited by examiner

AIMING SYSTEM FOR SLINGSHOTS AND PROJECTILE-LAUNCHING DEVICES

CROSS-REFERENCE TO RELATED APPLICATIONS

This application claims the benefit of U.S. Provisional Application No. 61/143,153, filed Jan. 7, 2009, and is a continuation-in-part of U.S. application Ser. No. 12/343,978, filed Dec. 24, 2008, now pending, which is a divisional of U.S. application Ser. No. 11/302,792, filed Dec. 14, 2005, now patented.

BACKGROUND OF THE INVENTION

The present invention relates generally to projectile launching devices and their components and, more particularly, to an aiming system for use with slingshots or other devices configured to launch projectiles.

Slingshots commonly are used for recreation and for hunting. Although slingshots have existed for centuries, the basic design and mechanics generally have remained constant over time.

Quite simply, a traditional slingshot comprises a handle and a pair of arms extending divergently upward from the handle. An elastic band is attached between the arms. Typically, centered on the elastic band is a pouch designed to hold a projectile.

After a projectile is placed in the pouch, the pouch is pulled backwards, away from the arms, thereby extending and stretching the elastic band to create potential energy. When the pouch is released, the potential energy of the elastic band is transformed to kinetic energy which is transferred to the projectile through the pouch. The project then is thrust forward, out of the pouch, away from the slingshot user and toward a desired target.

Various design enhancements have been made over the years in an attempt to improve the functionality of slingshots. For example, such improved slingshot devices include wrist braces to help stabilize shots, foldable designs to make the devices more portable, aiming and sighting mechanisms to improve accuracy, multi-band designs to improve band life and shot speed and pulley assemblies to produce increased projectile velocity with decreased force exertion by the user.

One such slingshot device improvement is disclosed in U.S. Pat. No. 7,484,505, issued Feb. 3, 2009, for a "Collapsible Locking Slingshot," by Saunders, concurrently owned with the present application, and herein incorporated by reference. Saunders discloses a collapsible locking slingshot device with a "shoot-over" design in which the elastic band passes over, rather than through, the arms during the shot. This design results in numerous advantages as described in the patent.

Other slingshot device design improvements developed by the prior art include various aiming or sighting systems. For example, such aiming or sighting systems are disclosed in U.S. Pat. No. 6,968,835 to Lee, U.S. Pat. No. 5,894,672 to Ellenburg et al., U.S. Pat. No. 5,803,067 to Ellenburg et al., U.S. Pat. No. 5,918,585 to Blanchard, U.S. Pat. No. 6,564,787 to Barry and U.S. Pat. No. 6,823,855 to Omi.

However, despite the numerous types of aiming or sighting systems known in the prior art, the art has not developed an aiming and sighting system that complements slingshot devices, and other projectile-launching devices, that use a "shoot-over"-type design. The instant invention solves that problem and provides an aiming system that not only complements "shoot-over" slingshot devices, but provides accurate and precise aiming.

BRIEF SUMMARY OF THE INVENTION

The present invention comprises an aiming system for projectile-launching devices. The system may be used with various slingshot devices, but is particularly useful for use with "shoot-over"-type slingshots and other projectile-launching devices that embody a "shoot-over"-type design.

In one disclosed embodiment, the aiming system of the present invention comprises a locking clip configured to matingly engage an arm of a "shoot-over"-type slingshot. In this disclosed embodiment, the integrated aiming or sighting system preferably comprises at least one fiber optic strand disposed within the clip whose ends (or tips) terminate at the forward face of the clip (the side of the clip facing the user when the shooting the slingshot).

In this manner, the tips of the at least one fiber optic strand create illuminated points, providing an illuminated aiming system that allows the user of the slingshot to look forward while shooting and to align the points with the target, the upper point being used to aim at closer targets and the consecutively lower points used to aim at more distant targets, respectively (to account for the downward trajectory of the projectile over distance due to gravitational forces).

The points of the fiber optic strand may be color coded to aid in the aiming process, and multiple fiber optic strands may be used. In the preferred embodiment of the present invention, four points are created by using two fiber optic strands, each of the fiber optic strands configured to produce a different color. In this matter, the points may alternate between two colors to provide better clarity when aiming.

In a disclosed embodiment, the clip includes openings to allow ambient light to enter the clip to provide a source of light to the fiber optic strand(s) in order to illuminate the tips of the fiber optic strand(s) (points).

In some embodiments, the clip of the disclosed embodiment may be constructed of a translucent material, such as plastic, and the ambient light may be transmitted through the body of the clip in order to provide a source of light to the fiber optic strands and illuminate the tips of the fiber optic strand(s) (points).

Similarly, in some embodiments, the arm of the slingshot (or other projectile launching device) may include openings to permit light to pass through the arm and into the clip in order to illuminate the tips of the fiber optic strand(s) (points).

In other embodiments of the aiming system of the present invention, particularly useful in low ambient light conditions, such as nighttime or inclement weather, the fiber optic strand(s) may be illuminated by one or more small powered LEDs or other artificial light sources disposed within the clip.

In still other embodiments of the aiming system of the present invention, also particularly useful in low ambient light conditions, such as nighttime or inclement weather, the fiber optic strand(s) may be replaced by small powered LEDs disposed at the rearward face of the clip.

In yet another embodiment of the aiming system of the present invention, the fiber optic strand(s) or LEDs (or other artificial light source) may be disposed in the arm of the slingshot (or other projectile launching device) such that the tips of the fiber optic strand(s) (points) or the LEDs may be viewable over the clip when the clip is engaged in the arm.

In other embodiments of the aiming system of the present invention, particularly useful when powered LEDs (or other artificial light source) are used, a switching mechanism may be operably connected to the LEDs (or other artificial light source) to activate the LEDs (or other artificial light source) when the band is tensioned in preparation for shooting the slingshot device. In such a configuration, the switch may be pressure-actuated such that the pressure force generated by the tensioned band closes the switch and causes the LEDs (or other artificial light source) to illuminate. The switching mechanism may be located in the clip or in the arm.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
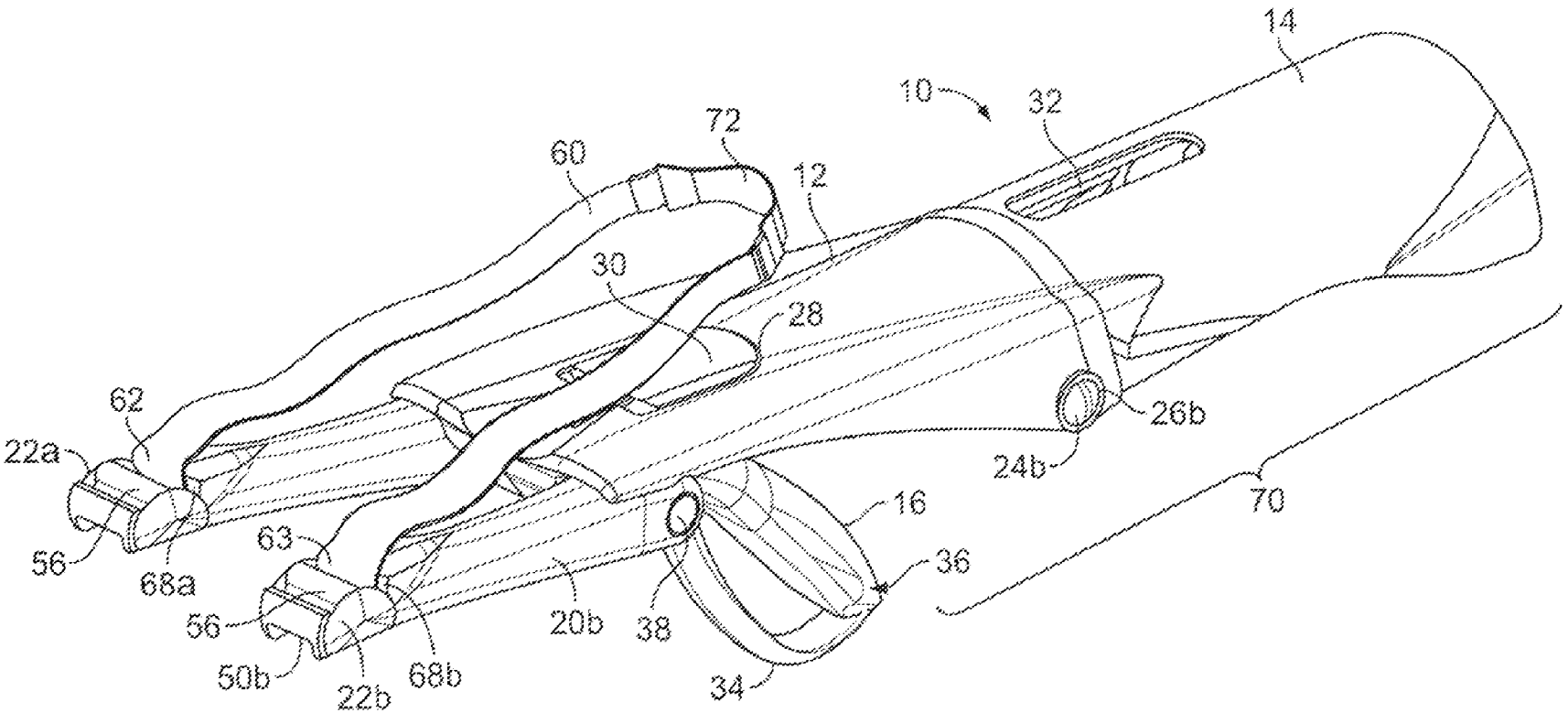
FIG. 1 is a perspective view of a "shoot-over"-type slingshot as is known in the art.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

FIGS. 1-4 illustrate "shoot-over"-type slingshot as known in the prior art. Specifically, FIGS. 1-4 illustrate a "shoot-over"-type slingshot as disclosed in U.S. Pat. No. 7,484,505, issued Feb. 3, 2009, for a "Collapsible Locking Slingshot," by Saunders, concurrently owned with the present application, and herein incorporated by reference. Saunders discloses a collapsible locking slingshot device with a "shoot-over" design in which the elastic band passes over, rather than through, the arms of the slingshot during the shot. This type of "shoot-over" design results in numerous advantages as described in the Saunders patent.

Figure 2:
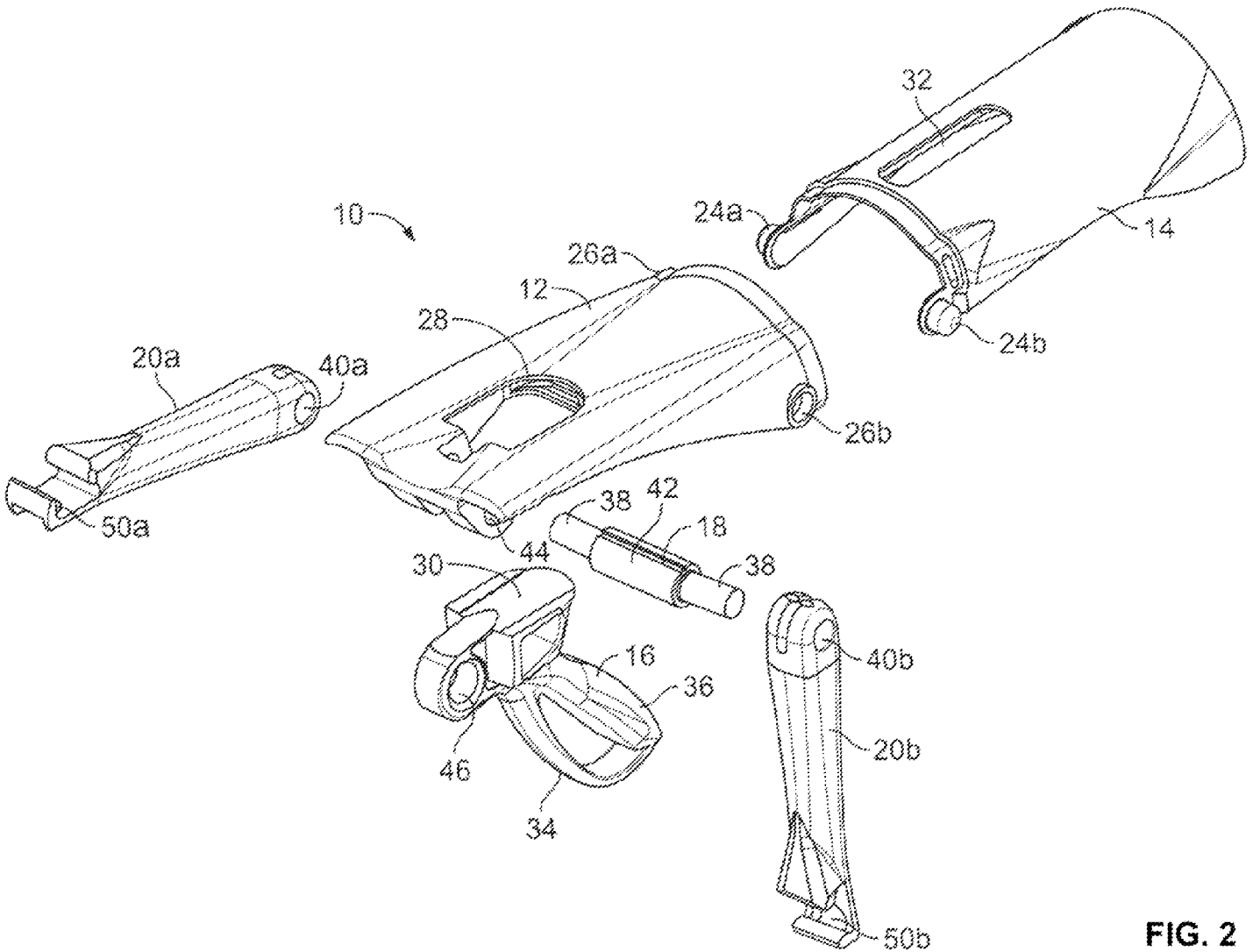
FIG. 2 is an exploded view of the "shoot-over"-type slingshot of FIG. 1.

As shown in FIGS. 1, 2, and 3 a "shoot-over"-type slingshot device 10 as known in the art may comprise a front panel 12, a rear panel 14, a handle 16, an axle 18, a pair of arms 20*a* and 20*b* and a pair of locking clips 22*a* and 22*b* (locking clips 22*a* and 22*b* are identical and, therefore, only locking clip 22*a* is depicted in the enlarged drawing shown in FIG. 2).

In the disclosed embodiment, front panel 12, rear panel 14, handle 16, arms 20*a* and 20*b* and locking clips 22*a* and 22*b* are constructed of a rigid, lightweight plastic material. Front panel 12 and rear panel 14 are designed to be generally gauntlet-shaped so as to surround and shield the top surface of a shooter's arm when in the opened, un-collapsed configuration.

Front panel 12 and rear panel 14 are connected via a hinged connection, which is created by nubs 24*a* and 24*b* defined in rear panel 14 mating with holes 26*a* and 26*b* in front panel 12. Front panel 12 is further comprised of an integrated port 28 designed to accept an upper portion 30 of handle 16 when the slingshot is in a fully-collapsed configuration. Rear panel 14 is further comprised of an integrated port 32 designed to accept a part 34 of a lower portion 36 of handle 16 when slingshot 10 is in a fully-collapsed configuration.

Ends 38 of axle 18 slide into bores 40*a* and 40*b* defined on arms 20*a* and 20*b*. Center portion 42 of axle 18 slides through an aperture 44 on front panel 12 and a bore 46 on handle 16, thereby connecting arms 20*a* and 20*b* and handle 16 to front panel 12. Arms 20*a* and 20*b* and handle 16 each are rotatably connected to axle 18 allowing for independent rotation thereof Alternatively, arms 20*a* and 20*b* may be secured to axle 18 and configured to rotate only with the rotation of axle 18, thereby maintaining arms 20*a* and 20*b* in alignment with each other. Positioned at the other end of arms 20*a* and 20*b* are grooves 50*a* and 50*b*, which are configured to matingly engage locking clips 22*a* and 22*b*.

Locking clips 22*a* and 22*b* (illustrated in FIGS. 3*a*-3*e*) are generally semi-circular in shape and are comprised of three main integrated elements: a large-diameter end 52 designed to secure flat bands, a small diameter end 54 designed to secure tubular bands (which, generally, are thicker than flat bands) and a grip 56 designed to facilitate engagement and removal of locking clips 22*a* and 22*b* within the grooves 50*a* and 50*b*.

This groove-and-clip design is capable of utilizing flat or tubular, single or multiple bands. If large-diameter end 52 of the clips is facing forward when the clips are inserted into the grooves, a thicker band (small tubular bands or thicker flat bands) may be used, and if small diameter end 54 is facing forward, thinner bands may be used. Each clip 22*a* and 22*b* includes a pair of outside plates 58 that help guide clips 22*a* and 22*b* into proper position within grooves 50*a* and 50*b*.

Figure 3A:
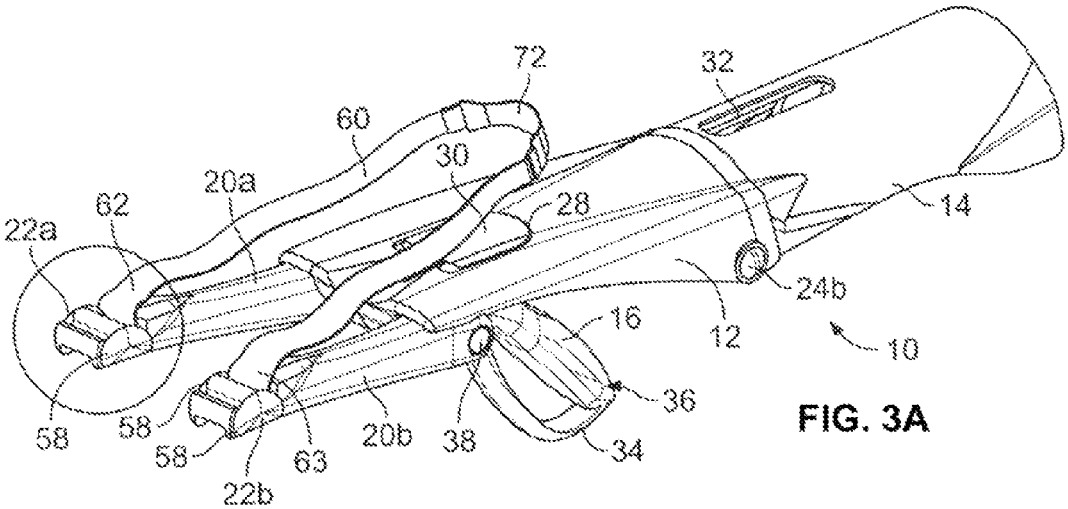
FIG. 3A is a perspective view of the "shoot-over"-type slingshot of FIG. 1.
Figure 3B:
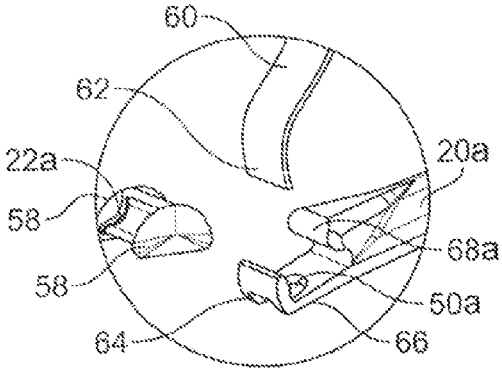
FIGS. 3B-3E are perspective views showing the steps to engage the locking clip in the arm to secure the band of the "shoot-over"-type slingshot of FIG. 1.
Figure 3D:
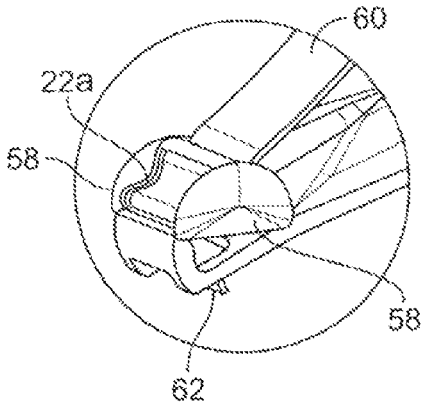
Figure 3C:
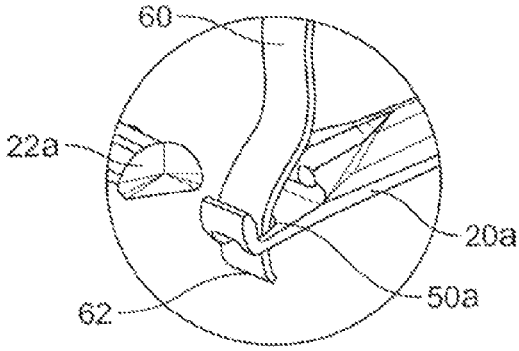
Figure 3E:
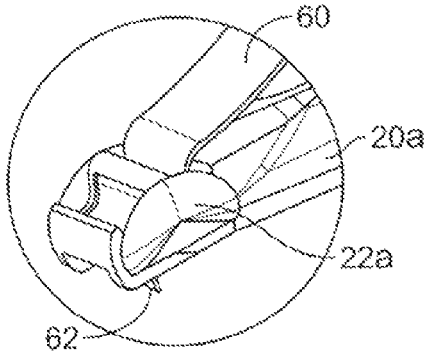
Figure 4:
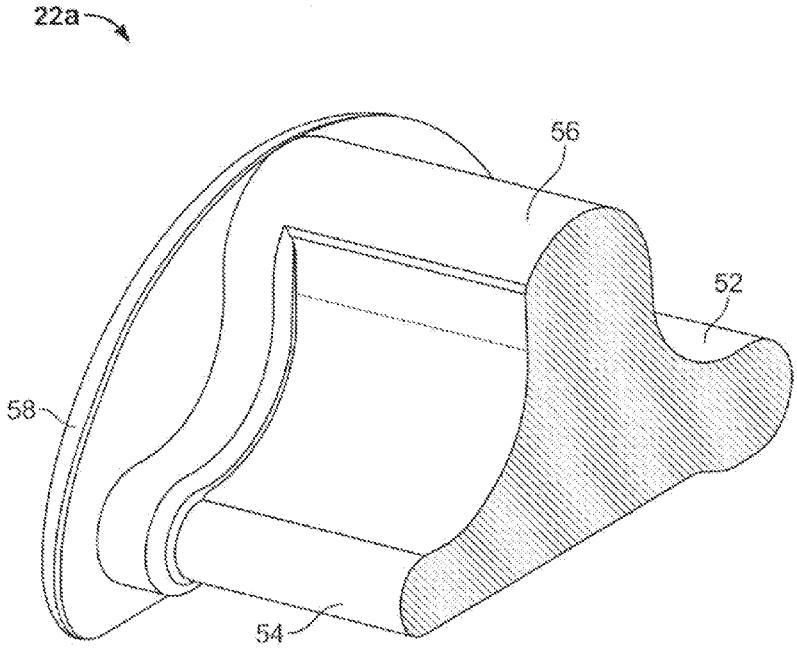
FIG. 4 is a perspective cross-sectional view of the locking clip of the "shoot-over"-type slingshot of FIG. 1.
Figure 5:
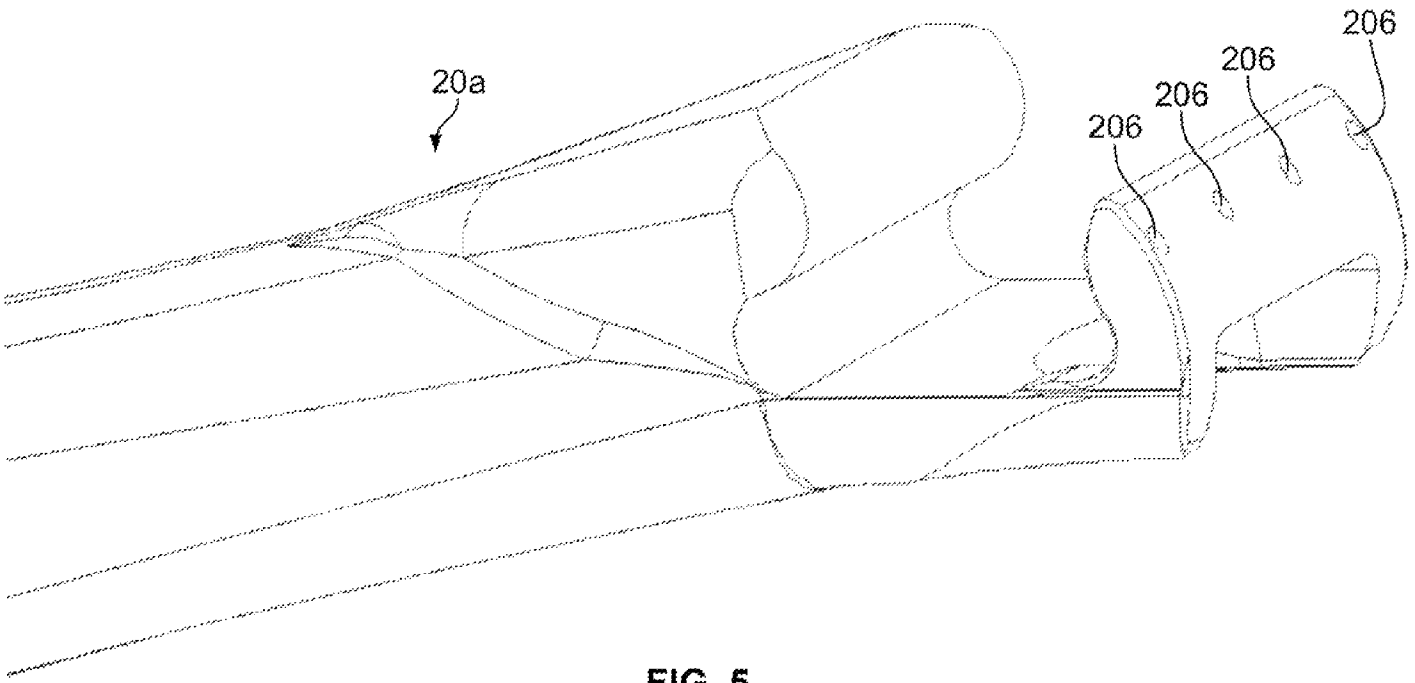
FIG. 5 is an enlarged, fragmentary perspective view of the arm of the "shoot-over"-type slingshot of FIG. 1 modified with openings to allow light to pass through the arm and to enter the locking clip.

The fully assembled collapsible locking slingshot is illustrated in FIG. 3*a* along with an illustrated guide (FIGS. 3*b*-3*e*) showing installation of band 60 using clips 22*a* and 22*b* in conjunction with grooves 50*a* and 50*b*.

To install band 60, a user positions one end 62 of band 60 into groove 50*a* and the other end 63 of band 60 into groove 50*b*. The ends of band 60 may pass through an opening 64 in the bottom portion 66 of groove 50*a*. Locking clip 22*a* then is inserted into groove 50*a* and locked into position. Clips 22*a* and 22*b* are locked into position by providing an overhang portion 68*a* and 68*b*, respectively, projecting over grooves 50*a* and 50*b*, respectively.

Clips 22*a* and 22*b* are positioned in grooves 50*a* and 50*b*, respectively and pushed downwardly past overhang portions 68*a* and 68*b*, respectively. Thus clips 22*a* and 22*b* are snapped-locked in a recess created by the walls of grooves 50*a* and 50*b* and the respective overhang portions 68*a* and 68*b*.

The "shoot-over"-type design of such prior art slingshot devices advantageously allows band 60 to dissipate residual energy left over after firing, minimizing recoil or shock to the user's hand and arm. Staged energy dissipation is achieved when band 60 travels forward without encountering other components of the slingshot.

For example, band 60 does not encounter the rearward facing prongs used to hold tubular bands in other non-"shoot-over"-type prior art slingshots, the posts of other non-"shoot-over"-type prior art slingshots or the band retainer guides on prior art pulley-equipped slingshots. Moreover, the "shoot-over"-type slingshot 10 as known in the art employs a pair of arms 20*a* and 20*b* that, when in the firing position, are substantially parallel to the slingshot user's arm, unlike prior art slingshot devices that have the arms perpendicular to, or at an angle to, the user's arm.

As shown in FIGS. 5-18, the preferred embodiment of the aiming system of the present invention comprises a locking clip 122 suitable to be used with prior art "shoot-over"-type slingshots as are known in the art, including without limitation slingshot 10 as discussed above. To that end, clip 122 in the preferred embodiment of the aiming system of the present invention is configured to replace one, or both, of locking clips 22*a* and 22*b*, discussed above, and to secure band 60 into groove 50*a* and/or 50*b*.

As shown in FIGS. 6-15, clip 122 in the preferred embodiment of the present invention is generally semi-circular in shape and comprises an end 152 configured to secure band 60 within groove 50*a* and/or 50*b*; a grip 156 configured to facilitate engagement and removal clip 122 within groove 50*a* and/or 50*b*; and, a pair of outside plates 158 that help guide clips 22*a* and 22*b* into proper position within grooves 50*a* and 50*b*.

Clip 122 preferably also comprises a cover 200 which is removable from clip 122 in the preferred embodiment in order to access and/or replace the fiber optic strand(s), LEDs or other artificial light sources (and/or their power sources) as further discussed below. Cover 200 is configured in the preferred embodiment with recesses 204 to ease in removal of cover 200 from clip 122.

Figure 8:
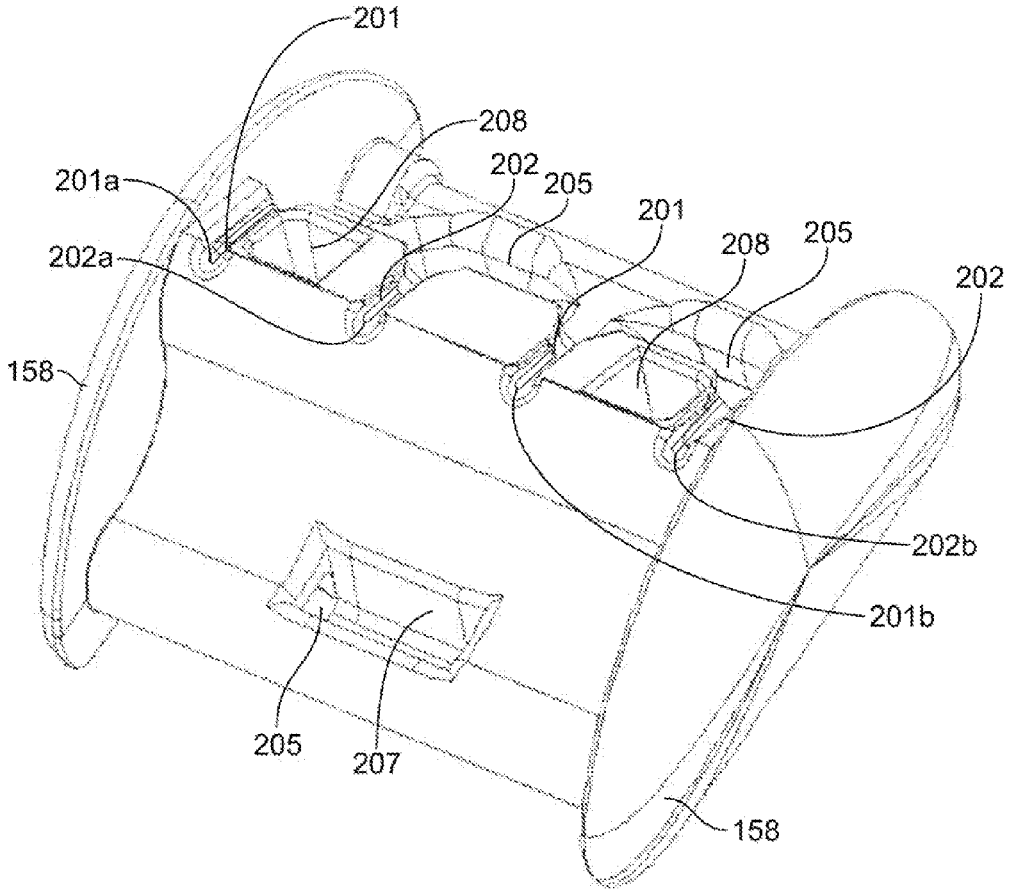
FIG. 8 is an enlarged front perspective view of the locking clip of the preferred embodiment of the aiming system of the present invention, with the top cover removed.
Figure 9:
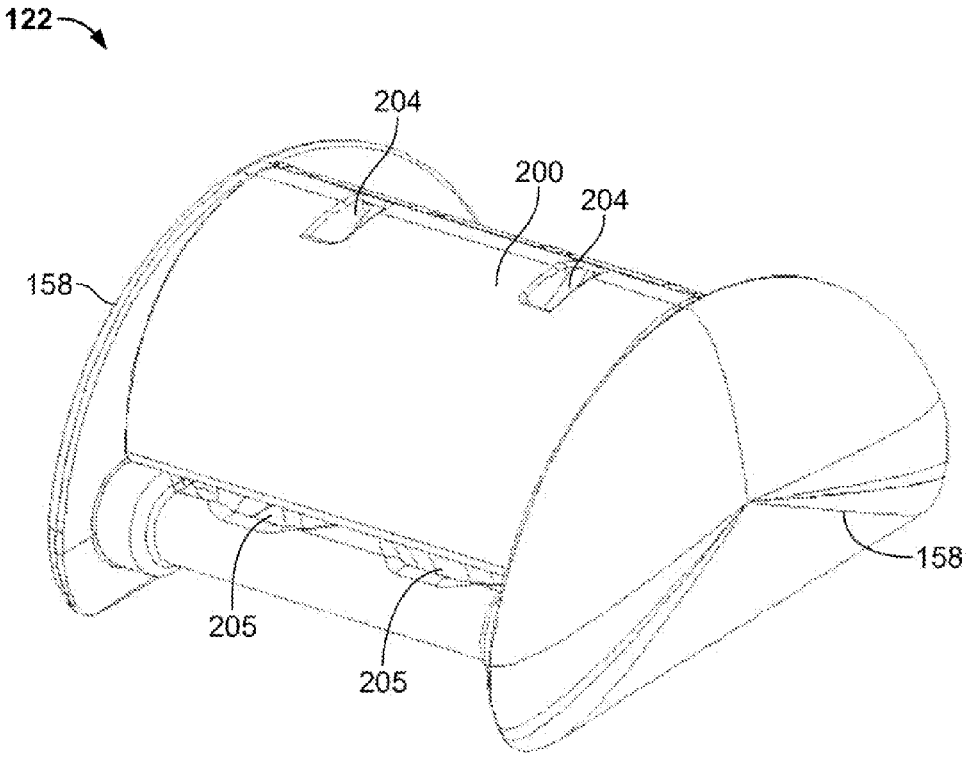
FIG. 9 is an enlarged rear perspective view of the locking clip of the preferred embodiment of the aiming system of the present invention.

In the preferred embodiment of the aiming system of the present invention, clip 122 further comprises at least one, and preferably two, fiber optic strands (201 and 202, as shown in FIG. 8) disposed within the body of clip 122. Fiber optic strands 201 and 202 each have two ends (201*a* and 201*b*, and 202*a* and 202*b*, respectively) that are disposed in openings 203 formed in grip 156 of clip 122.

Preferably, openings 203 are evenly distributed across the width of clip 122, but those skilled in the art will recognize that openings 203 also may be unevenly distributed depending on, for example, the target distances desired to be identified by the aiming system.

Fiber optic strands 201 and 202 comprise short lengths of fiber optic material configured to transmit ambient light to which strands 201 and 202 are exposed to the ends 201*a* and 201*b*, and 202*a* and 202*b*, respectively, of strands 201 and 202. The transmission of such ambient light causes the ends 201*a* and 201*b*, and 202*a* and 202*b*, respectively, of strands 201 and 202 to illuminate. Such fiber optic material is well known to those skilled in the art and may comprise plastic, glass or any other suitable material as is known in the art.

As discussed above, in the preferred embodiment of the aiming system of the present invention, two fiber optic strands, 201 and 202, are used, thereby creating four illuminated points at the ends 201*a* and 201*b*, and 202*a* and 202*b*, respectively, of strands 201 and 202. The illuminated points as an aiming system when clip 122 is disposed in slingshot 10, with each point represented a desired target distance, as further discussed below.

Figure 6:
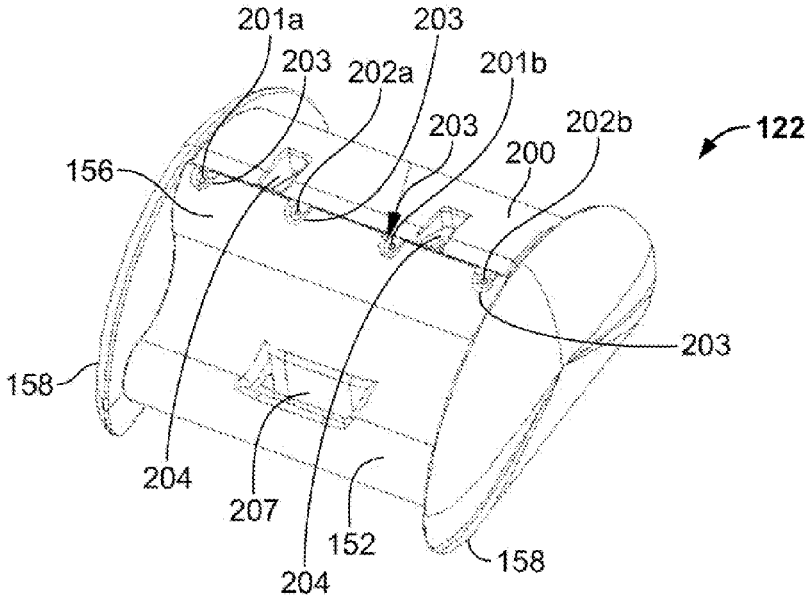
FIG. 6 is an enlarged front perspective view of the locking clip of the preferred embodiment of the aiming system of the present invention.
Figure 7:
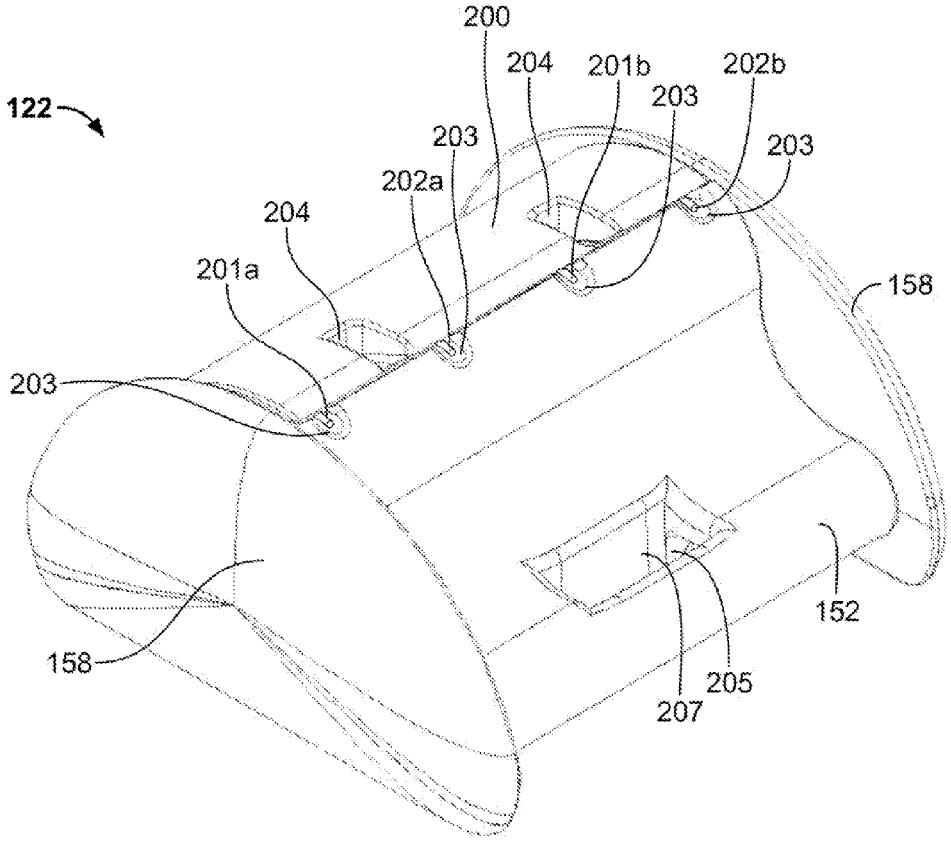
FIG. 7 is an enlarged front perspective view of the locking clip of the preferred embodiment of the aiming system of the present invention.

In the preferred embodiment, strands 201 and 202 are configured to cause their respective ends 201*a* and 201*b*, and 202*a* and 202*b*, to illuminate in different colors, such that ends 201*a* and 201*b* illuminate in one color while ends 202*a* and 202*b* illuminate in a different color. Additionally, ends 201*a* and 201*b*, and 202*a* and 202*b*, respectively, of strands 201 and 202 are preferably disposed in openings 203 such that the respective ends of strands 201 and 202 alternate along the width of clip 122 (as shown in FIG. 6).

Openings 203 are preferably formed as channels in the body of clip 122 within which a small length of strands 201 and 202 rest such that the ends 201*a* and 201*b*, and 202*a* and 202*b*, respectively, of strands 201 and 202 remain properly positioned. Ends 201*a* and 201*b*, and 202*a* and 202*b*, respectively, of strands 201 and 202 also may be held in place through frictional engagement with openings 203 and/or through small clips or other means as recognized by those skilled in the art.

Such an alternating pattern of ends 201*a* and 201*b*, and 202*a* and 202*b*, respectively, of strands 201 and 202 is particularly useful when strands 201 and 202 are configured to illuminate their respective ends in different colors. In this manner, an alternating color pattern (such as orange-redorange-red, or green-orange-green-orange) can be achieved. An alternating color pattern can advantageously assist when using the aiming system of the present invention by providing contrasting colors to allow easier alignment with a target.

Although two fiber optic strands, 201 and 202, are used in the preferred embodiment of the aiming system of the present invention, it will be appreciated by those skilled in the art that additional, or fewer, fiber optic strands may be used without departing from the scope of the present invention.

That is, a single fiber optic strand could be used to provide either one or two aiming points and the number of openings could be reduced accordingly. Similarly, additional fiber optic strands could be used in order to create additional aiming points. Additional fiber optic strands also could be used to create a greater variety of colors for the aiming points, for example, by using four fiber optic strands having short lengths, each strand configured to illuminate its tip in a different color, and mounting only one end of each strand in openings 203.

Figure 10:
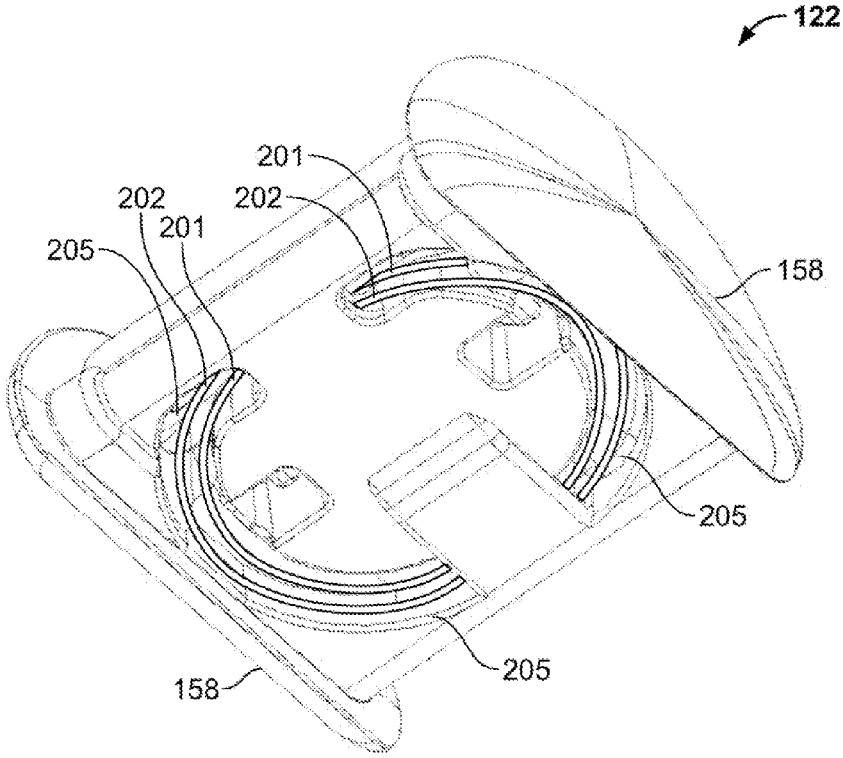
FIG. 10 is an enlarged bottom perspective view of the locking clip of the preferred embodiment of the aiming system of the present invention, showing the looped fiber optic strands disposed therein.
Figure 11:
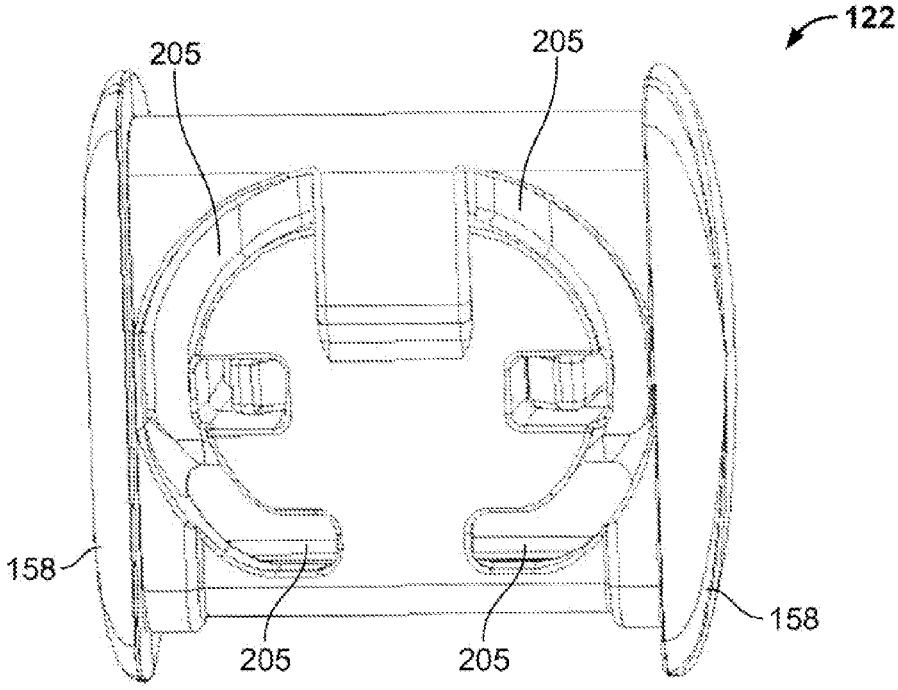
FIG. 11 is an enlarged bottom perspective view of the locking clip of the preferred embodiment of the aiming system of the present invention.
Figure 12:
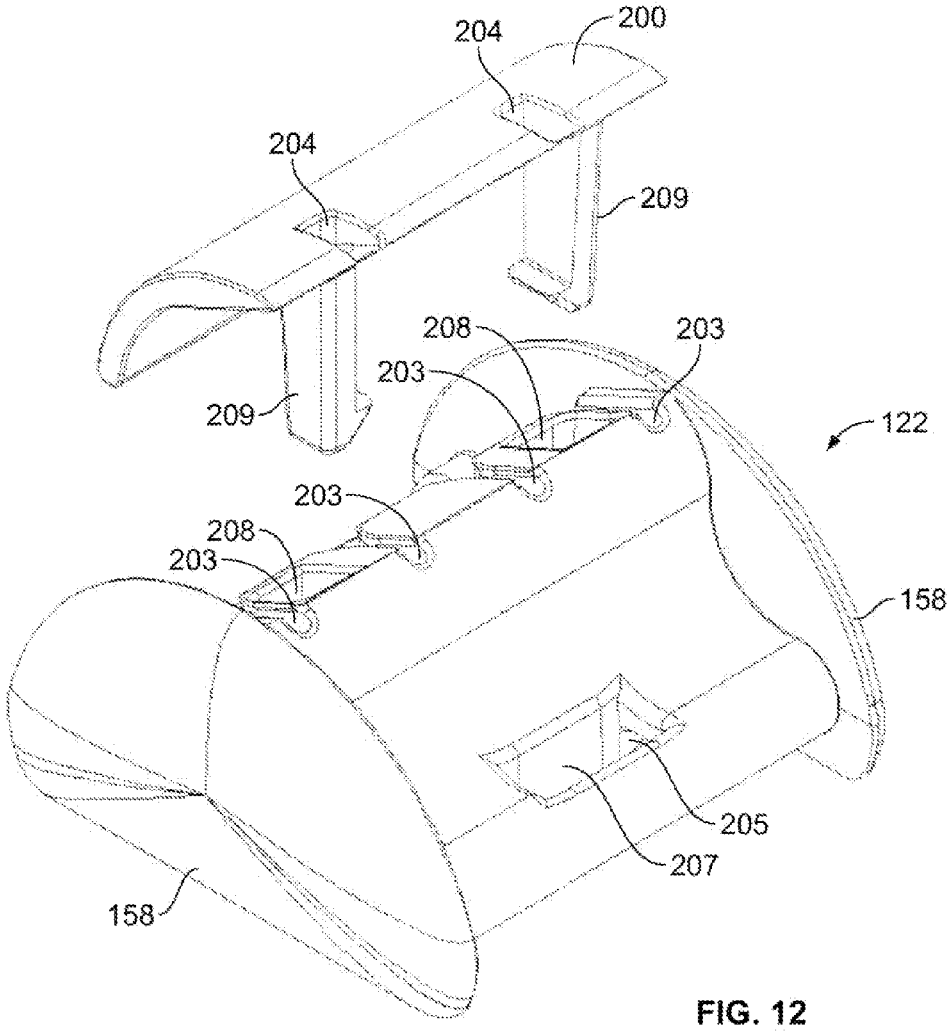
FIG. 12 is an enlarged exploded front perspective view of the locking clip of the preferred embodiment of the aiming system of the present invention.
Figure 13:
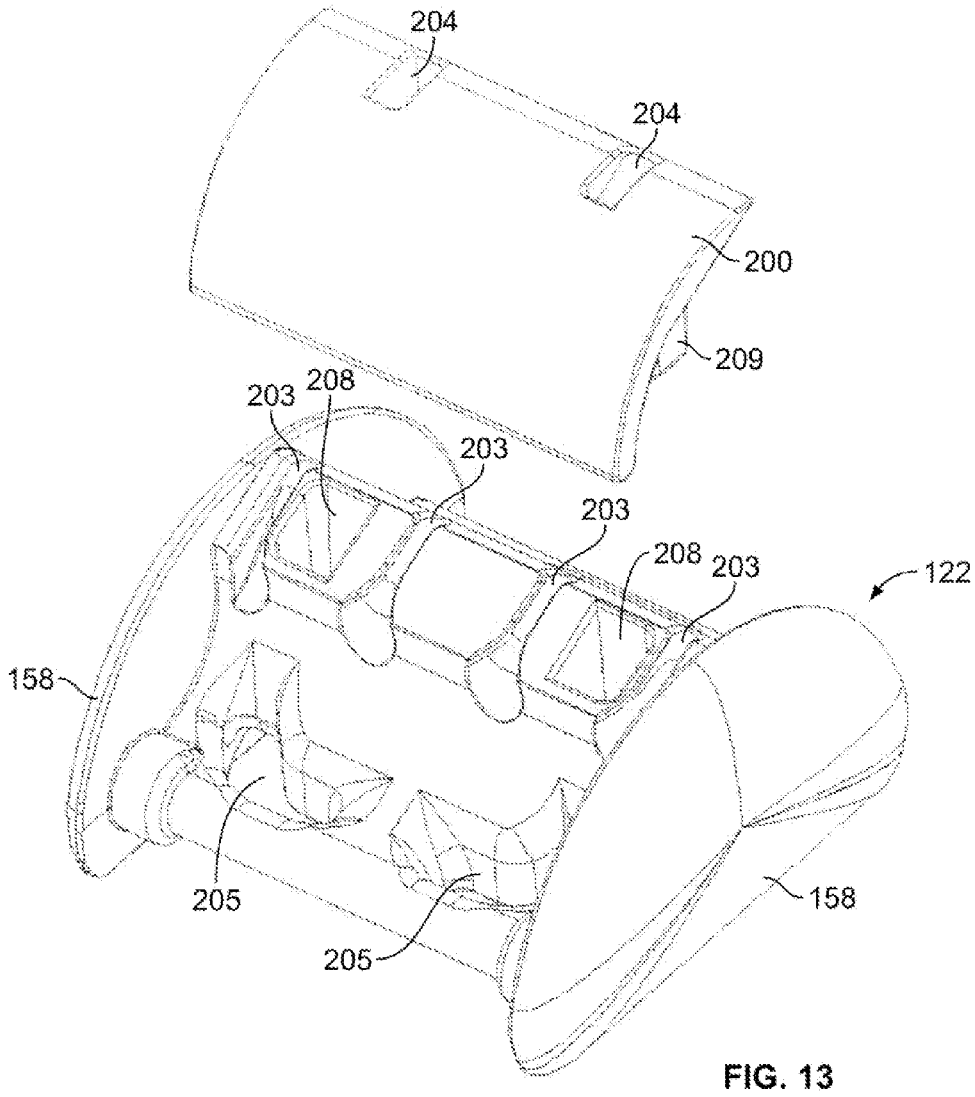
FIG. 13 is an enlarged exploded rear perspective view of the locking clip of the preferred embodiment of the aiming system of the present invention.
Figure 14:
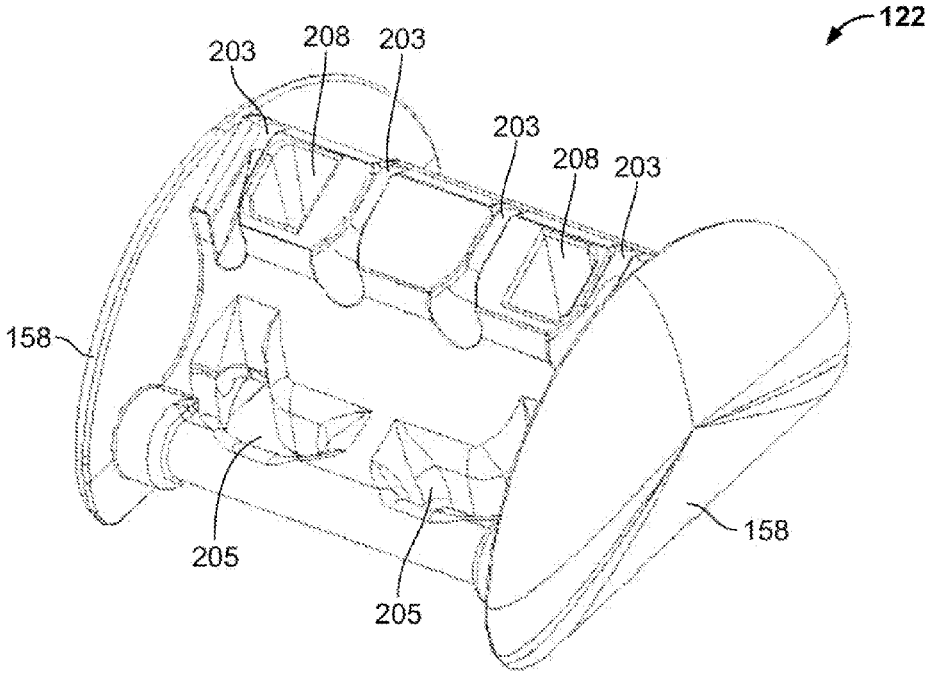
FIG. 14 is an enlarged rear perspective view of the locking clip of the preferred embodiment of the aiming system of the present invention, with the top cover removed.
Figure 15:
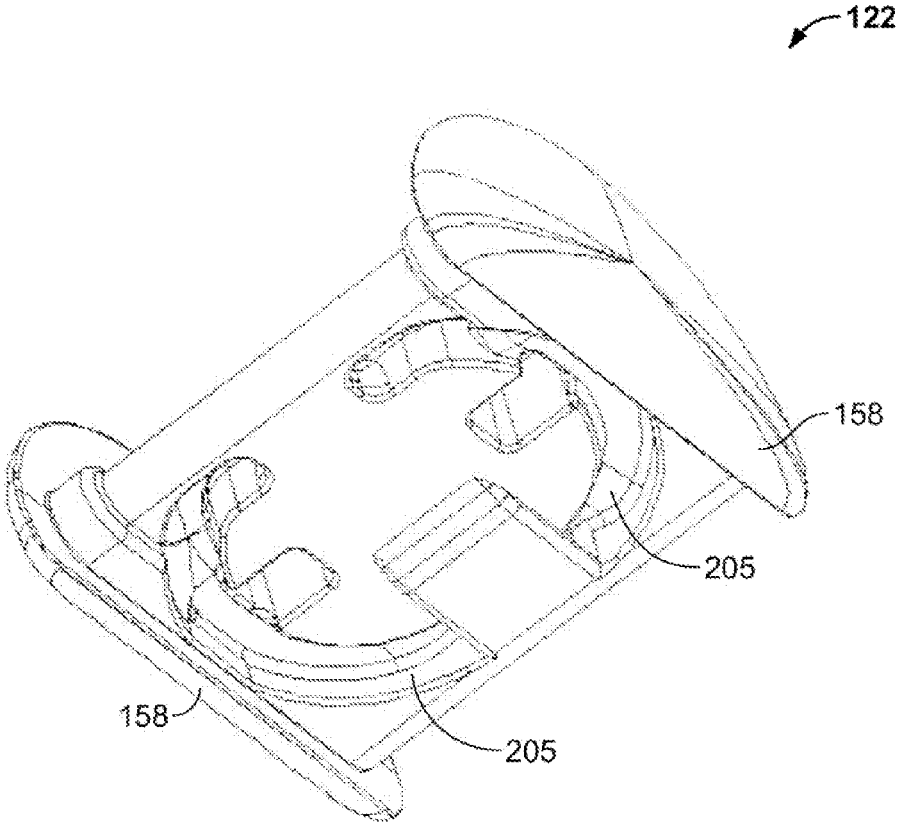
FIG. 15 is an enlarged bottom perspective view of the locking clip of the preferred embodiment of the aiming system of the present invention, with the top clip removed.
Figure 16:
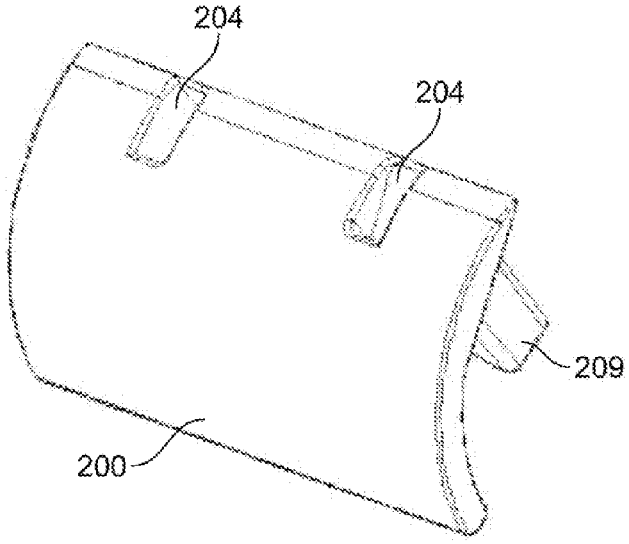
FIG. 16 is an enlarged side perspective view of the top cover of the locking clip of the preferred embodiment of the aiming system of the present invention.
Figure 17:
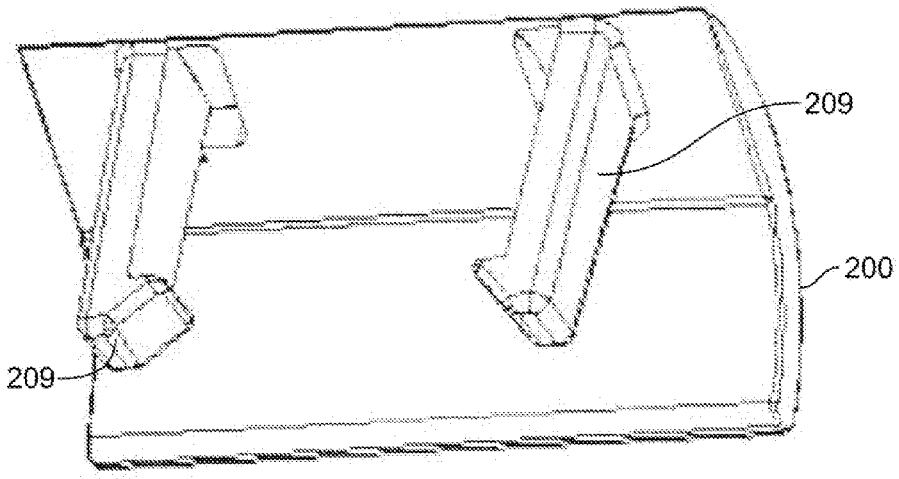
FIG. 17 is an enlarged bottom perspective view of the top cover of the locking clip of the preferred embodiment of the aiming system of the present invention.
Figure 18:
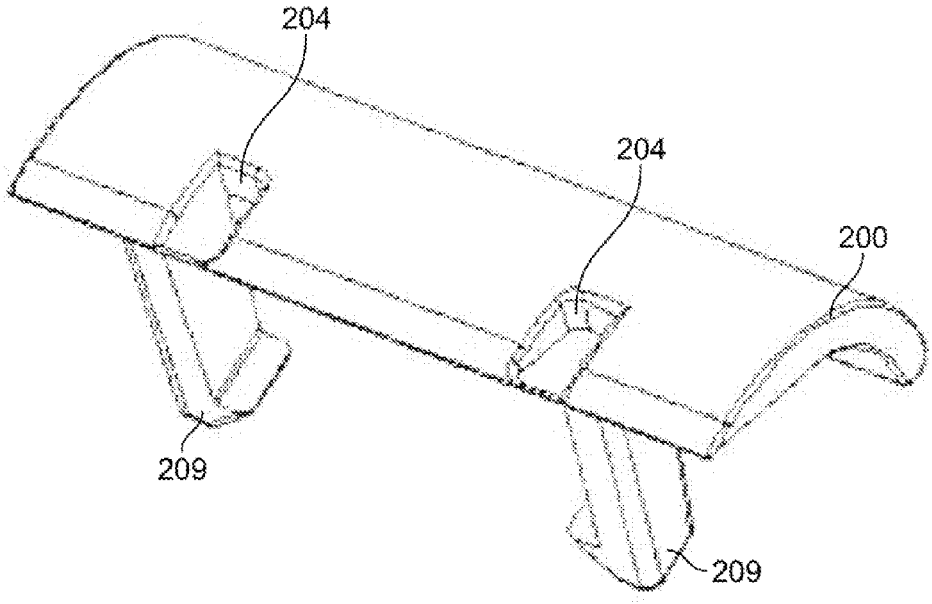
FIG. 18 is an enlarged top perspective view of the top cover of the locking clip of the preferred embodiment of the aiming system of the present invention.

In the preferred embodiment, fiber optic strands 201 and 202 are disposed within the body of clip 122 in such a manner that they form loops (as shown in FIG. 10) within the body of clip 122. Such a configuration allows fiber optic strands 201 and 202 to be of a greater length, thereby providing more surface area and allowing strands 201 and 202 to more capture more ambient light for transmission to ends 201*a* and 201*b*, and 202*a* and 202*b*, respectively, of strands 201 and 202.

To that end, as shown in FIGS. 8, 10, 11, 13, 14 and 15, clip 122 is formed with a plurality of internal channels 205 in which strands 201 and 202 are disposed. Channels 205 are configured to provide place for the lengths of strands 201 and 202 to be stored while at the same time allowing the lengths of strands 201 and 202 to be exposed to sufficient ambient light. To that end, the bottom of clip 122 preferably is open (uncovered) as shown in FIG. 10 to permit ambient light to reach the lengths of strands 201 and 202. Those skilled in the art will recognize that the precise configuration and orientation of channels 205 may vary without departing from the scope of the present invention.

When clip 122 is used with the prior art "shoot-over"-type slingshot 10, discussed above, opening 64 in the bottom portion 66 of groove 50*a* (and/or 50*b*) of arm 20*a* (and/or 20*b*) allows ambient light to pass through opening 64 into the open (uncovered) bottom of clip 122 in order to reach the lengths of strands 201 and 202. Additionally, when clip 122 is used with the prior art "shoot-over"-type slingshot 10, discussed above, arm 20*a* (and/or 20*b*) may be formed with openings 206 disposed in, and passing through, the outer wall of groove 50*a* (and/or 50*b*) to allow additional ambient light to pass through arm 20*a* (and/or 20*b*) to reach clip 122. Those skilled in the art will recognize that openings 206 may be of various numbers, geometries and locations without departing from the scope of the instant invention.

To provide further access to ambient light, clip 122 in the preferred embodiment includes an opening 207 formed in the forward face of clip 122 and disposed, preferably, above at least a portion of one of channels 205 such that ambient light can be transmitted through opening 207 to strands 201 and 202. Additionally, to provide even greater access to ambient light, the entire body of clip 122 (or at least portions thereof) may be formed of a translucent material, such as any of a number of plastics, that permits ambient light to be transmitted through clip 122 to strands 201 and 202.

As discussed above, and as shown in FIGS. 12, 13, 15, 16, 17 and 18, clip 122 preferably comprises a removable cover 200 to allow access to the inside of clip 122, for example to permit replacement of fiber optic strands 201 and 202, or LEDs or other artificial light sources (and/or their power sources), as further discussed below. In the preferred embodiment, cover 200 is formed as a generally curved member having a plurality of clips 209 extending downwardly therefrom and configured to matingly engage receptacles 208 formed in the body of clip 122.

In use, when clip 122 is used with prior art "shoot-over"-type slingshot 10, as discussed above, clip 122 replaces clip 22*a* and/or clip 22*b* and is inserted into groove 50*a* and/or 50*b*, respectively, in the same manner as discussed above. When a user raises slingshot 10 to aim at a target, slingshot 10 preferably is held in a vertical orientation such that arms 20*a* and 20*b* are in vertical alignment (that is, depending on whether the user is left-handed or right-handed), arm 20*a* is disposed above arm 20*b*, or arm 20*b* is disposed above arm 20*a*.

In this configuration, clip 122 is positioned in a vertical manner and openings 203 are aligned vertically. As ambient light is transmitted to strands 201 and 202 disposed inside clip 122, the ends 201*a* and 201*b*, and 202*a* and 202*b*, respectively, of strands 201 and 202 illuminate and provide a series of points creating aiming system for alignment with a desired target. The upper point (end 201*a*) may be used for closer targets, while the lower point (end 202*b*) may be used for more distant targets. The positioning of the aiming points accounts for the downward trajectory of the projectile over distance due to the effect gravitational forces, as recognized by those skilled in the art.

Various embodiments of the aiming system of the present invention are possible within the scope of the present disclosure. For example, it will be appreciated by those skilled in the art that the aiming system is not limited to use with slingshots, and may be used with any "shoot-over"-type projectile launching device because the aiming points will be visible to the user of such device due to the inherent design of the device.

Moreover, several additional embodiments of the aiming system of the present invention are possible within the scope of the present disclosure. For example, fiber optic strands 201 and 202 may be replaced with light emitting diodes (LEDs) (or any other suitable artificial light source as is known in the art). Such an embodiment is shown in FIG. 20.

Figure 20:
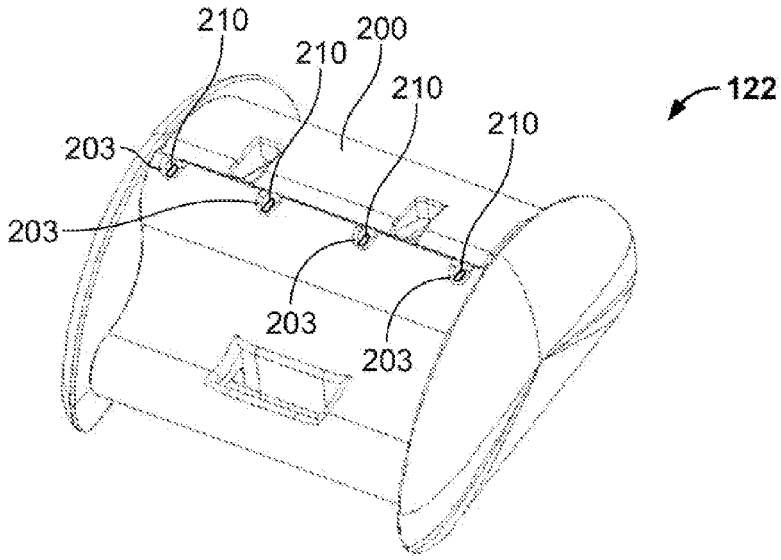

As shown in FIG. 20, clip 122 as described above has been modified such that fiber optic strands 201 and 202 have been replaced by a series of LEDs 210. LEDs 210 are mounted in or around openings 203 formed in or around openings 203 and may be powered by a battery (not shown). A switching device (not shown) may disposed on the bottom of clip 122 (or in any other convenient location) to actuate LEDs 210. In this manner, LEDs 210 can provide on-demand illuminated points for aiming system to be used in the manner described above. The batteries may be replaced by removing cover 200 as discussed above.

In a similar embodiment, fiber optic strands 201 and 202 may be supplemented by, rather than replaced by, LEDs 210 in order to provide a source of ambient light to fiber optic strands 201 and 202. In such an embodiment, LEDs 210 may be disposed within the body of clip 122 in proximity to fiber optic strands 201 and 202, and may be powered by a battery and actuated by a switching device in a similar manner as described in the preceding paragraph.

In yet another embodiment of the aiming system of the present invention, the fiber optic strands and/or the LEDs (or other artificial light source) may be disposed in the arm of the slingshot (or other projectile launching device), instead of the clip, such that the tips (or ends) of the fiber optic strand(s) or the LEDs may be viewable over the clip when the clip is engaged in the arm, thereby creating aiming points.

Figure 19:
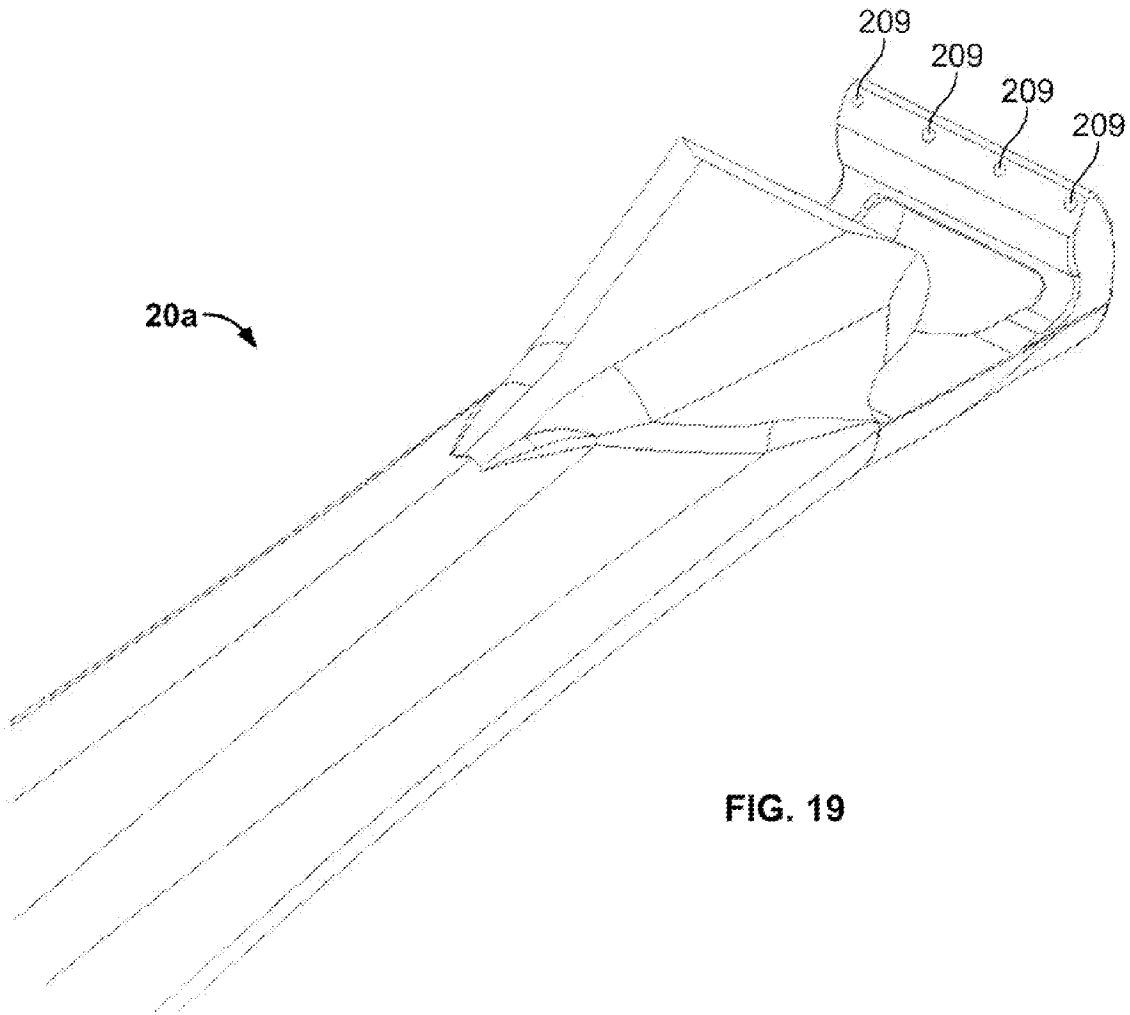
FIG. 19 is enlarged, fragmentary perspective view of an alternate embodiment of the aiming system of the present invention as integrated into the arm of a slingshot; and, FIG. 20 is an enlarged perspective view of the locking clip of the preferred embodiment of the aiming system of the present invention using LEDs instead of fiber optic strands.

In this embodiment, shown in FIG. 19, the arm of the slingshot may be configured such that the ends of the fiber optic strands or LEDs (for this purpose interchangeably identified as 209) may be formed in the arm of the slingshot in a manner that permits the tips of the fiber optic strands or the LEDs may be viewable over the clip when the clip is engaged in the arm. In this embodiment, the clip may be formed in a smaller profile to allow the tips of the fiber optic strands or the LEDs to be viewable over the top of the clip.

In other embodiments of the aiming system of the present invention, particularly useful when powered LEDs (or other artificial light source) are used, a switching mechanism may be operably connected to the LEDs (or other artificial light source) to activate the LEDs (or other artificial light source) when the band is tensioned in preparation for shooting the slingshot device. In such a configuration, the switch may be pressure-actuated such that the pressure force generated by the tensioned band closes the switch and causes the LEDs (or other artificial light source) to illuminate. The switching mechanism may be located in the clip or in the arm.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An aiming system, comprising:

a "shoot-over"-type projectile-launching device, the projectile-launching device having at least one aiming point capable of being illuminated, wherein the aiming point is configured to assist a user of the projectile-launching device to aim a projectile at a target located at a distance from the projectile-launching device, and wherein the at least one aiming point illuminates before the projectile is launched.

2. The aiming system of claim 1 wherein the projectile-launching device comprises a slingshot.

3. The aiming system of claim 1 wherein the projectile-launching device is not a slingshot.

4. The aiming system of claim 1 wherein at least one aiming point comprises a plurality of illuminated aiming points.

5. The aiming system of claim 1 wherein the at least one aiming point is illuminated by an ambient light source.

6. The aiming system of claim 1 wherein the at least one aiming point is illuminated by an artificial light source.

7. The aiming system of claim 1 wherein the at least one aiming point comprises at least one fiber optic strand.

8. The aiming system of claim 1 wherein the at least one aiming point comprises at least one light emitting diode (LED).

9. The aiming system of claim 1 wherein the at least one aiming point is disposed in a clip connected to the projectile-launching device.

10. The aiming system of claim 1 wherein the aiming point is disposed in an arm of the projectile-launching device.

11. An aiming system for a "shoot over"-type slingshot having a pair of arms, the aiming system comprising:

a clip, the clip configured to matingly engage one of the pair of arms of the slingshot and to secure a band thereto;

at least one aiming point capable of being illuminated disposed in the clip, wherein the aiming point is configured to assist a user of the projectile-launching device to aim a projectile at a target located at a distance from the projectile-launching device, and wherein the at least one aiming point illuminates before the projectile is launched.

12. The aiming system of claim 11 wherein the least one aiming point comprises a plurality of aiming points.

13. The aiming system of claim 12 wherein the plurality of aiming points comprise a plurality of colors.

14. The aiming system of claim 11 wherein the at least one aiming point is illuminated by an ambient light source.

15. The aiming system of claim 11 wherein the at least one aiming point is illuminated by an artificial light source.

16. The aiming system of claim 11 wherein the at least one aiming point comprises at least one fiber optic strand.

17. The aiming system of claim 11 wherein the at least one aiming point comprises at least one light emitting diode (LED).

18. The aiming system of 16 wherein the at least one fiber optic strand comprises a plurality of fiber optic strands, the fiber optic strands disposed within the clip.

19. The aiming system of claim 11 wherein the clip further comprises openings configured to allow ambient light to enter the clip to illuminate the at least one aiming point.

20. The aiming system of claim 11 wherein the clip is comprised of an at least partially translucent material configured to permit ambient light to enter the clip to illuminate the at least one aiming point.

* * * * *